United States Patent [19]

Weiss et al.

[11] 4,043,008

[45] Aug. 23, 1977

[54] NOISE REDUCTION SYSTEM

[75] Inventors: William Robert Weiss, Walnut Creek, Calif.; James Judson Cooksey, Colonial Heights; Phillip Leroy Mullins, Matoaca, both of Va.

[73] Assignee: Allied Chemical Corporation, Morris Township, N.J.

[21] Appl. No.: 721,262

[22] Filed: Sept. 8, 1976

[51] Int. Cl.[2] ..... D02G 1/16

[52] U.S. Cl. ..... 28/271; 181/33 C

[58] Field of Search ..... 28/1.4, 72.12, 71.3, 28/240, 245, 246, 271, 272; 226/7, 97; 181/33 R, 33 C, 33 G, 33 K; 425/72, 211

[56] References Cited

U.S. PATENT DOCUMENTS

| | | | |
|---|---|---|---|
| 2,764,250 | 9/1956 | Jeffords | 181/33 C |
| 3,167,847 | 2/1965 | Gonsalves | 28/1.4 |
| 3,305,910 | 2/1967 | Clement | 28/1.4 |
| 3,713,509 | 1/1973 | Carroll | 181/33 K |
| 3,905,075 | 9/1975 | Boggs et al. | 28/71.3 X |

*Primary Examiner*—Louis K. Rimrodt
*Attorney, Agent, or Firm*—Richard A. Anderson

[57] ABSTRACT

A noise reduction system is disclosed for use with a draw point localizing jet which has yarn passages, a string-up slot, and conduits for admitting treating fluid thereinto. The system comprises an exhaust muffler and access slot silencing means. The exhaust muffler comprises a housing lined with removable inserts of heat resistant, metallic sound absorbing material. The exhaust muffler has a hinged door operating in conjunction with the access slot silencing means. The muffler and access slot silencing means open and close for string-up and operation. The system lowers the overall noise level of the jet by muffling the noise sources during operation.

28 Claims, 6 Drawing Figures

NOISE REDUCTION SYSTEM

BACKGROUND OF THE INVENTION

This invention relates to an apparatus for noise reduction in a yarn treating system. In particular, it relates to a noise reduction system for use in conjunction with a yarn treating jet for the continuous fluid treatment of running ends of yarn. The jet has yarn passages, with adjacent access slots to facilitate string-up, as well as fluid conduits in communication with each of the yarn passages for delivery of the treating fluid.

Throughout the present specification and claims, the term "dB(A)" (decibels - A-weighted) connotes a unit of measurement of sound level corrected to the A-weighted scale, as defined in ANSI S1.4–1971, using a reference level of 20 micropascals ($2\times10^{-5}$ Newtons per square meter). The term "ΔdB(A)" refers to the difference between two noise levels where each level is expressed in units of dB(A). The term "yarn" is employed in a general sense to indicate strand material, either textile or otherwise, and including a continuous, often plied, strand composed of fibers, filaments, glass, metal, asbestos, paper, or plastic, or a noncontinuous strand such as staple, and the like. An "end" is one or a contiguous group of such strands of yarn. The treating fluid to be used may be virtually any gas which approaches ideal gas behavior, such as air, steam, nitrogen, oxygen, carbon dioxide, etc.

Jets have become widely used in recent years for the treatment of industrial and textile yarns. Different jets are used for the various end uses with specific designs having been developed according to the yarn treatment to be effected. Fluid jets have been utilized for such diverse yarn treating operations a conveying, twisting, crimping, fluffing, localizing the draw point, or otherwise agitating or treating the yarn by means of treating fluid.

All of these jets utilize a fluid which may issue therefrom at high speeds and pressures creating an extremely high noise level. The problem may be further compounded when the treatment comprises a series of fluid treating jets and/or when a plurality of treatment positions are operated simultaneously. The noise produced by operation of a fluid treating jet which has a yarn passage with an adjacent access slot primarily issues from the yarn passage via its exit end and the adjacent access slot.

With respect to sealing of the adjacent access slot, several devices are known. U.S. Pat. No. 3,296,679 relies upon the slideability of a closure plate and gravity to seal the access slot of a fluid treating jet. U.S. Pat. No. 3,905,075 discloses a noise reduction and heat direction system wherein actuating means trips the pivot of noise damping means to cause a wedge to seal the access slot. While the apparatus of both patents effectively seals the access slot during fluid treatment, it is preferred, when viewing the closure of the access slot as a component of a noise reduction system, that this occur substantially simultaneously with closure of a treating jet exit muffler after string-up and alignment. Positioning of the treatment apparatus may, however, preclude the combining of these two actions with the above disclosed apparatuses and therefore, a viable alternate is desirable. One such alternate would be to provide a fluid treating jet the access slot of which is automatically sealed by fluid operation of the jet. Two devices which accomplish this object are described in U.S. Pat. Nos. 3,363,294 and 3,394,440. Both rely upon fluid actuated movement of either the housing or closure means within the housing for the alignment or misalignment of yarn receiving slots during string-up and operation. It would be less expensive to accomplish simultaneous closure via external means rather than by redesigning the jet.

U.S. Pat. Nos. 3,127,729, 3,167,847, and 3,713,509 relate to various noise suppressors for yarn treating jets. The most common method employed to reduce the high noise levels is to substantially enclose the yarn treating jet or its exit end with a sound absorbing material. The actual sound absorbing materials disclosed by these patents are high porosity low density structures (U.S. Pat. No. 3,713,509); rigid sound absorbing material such as glass fibers (U.S. Pat. No. 3,127,729); and foam rubber, felt, or porous plastics (U.S. Pat. No. 3,167,847). Unfortunately, these materials have been found unsatisfactory for use in yarn treating jets where the treating fluid has temperatures in the range of 250° to 500° C. and pressures ranging from approximately 60 to 125 psig, and where the yarn speed is quite high, for example, 6,000 feet per minute. The high temperature of the treating fluid, which is substantially constant during treatment, will cause a rapid deterioration of these materials. An added problem for consideration is that of accumulated contaminant. Contaminant in a jet of the aforementioned type has two primary sources, the finish applied to the yarn prior to its entry into the yarn treating jet and the yarn itself. Some of the finish is instantaneously burnt off or blown off the yarn by the treating fluid inside the jet. Some of the resultant mist will remain inside the jet and muffler and eventually soak into or saturate the muffler components and yarn passageway. Sound absorbing material which cannot be cleaned must be thrown out and replaced due to this contamination. The other contaminant source is the yarn itself, a small surface portion of which is burnt off or abraded off when treating with high temperature fluid, and which accumulates in a fashion similar to that of the finish contaminant. It is therefore desirable to provide a sound absorbing material which functions to reduce noise as well, if not better, than the prior art materials, while extending its useful life. Such a sound absorbing material must be highly resistant to destruction by high temperatures and accumulated contaminant as well as easily removable for periodic cleansing.

None of the prior art patents teach the apparatus of the present invention for use in a yarn treating system wherein the problems of temperature, string-up access, and accumulated contaminant are solved while substantially reducing the noise level.

SUMMARY OF THE INVENTION

The present invention provides a noise reduction system for use in conjunction with a yarn treating jet which has at least one yarn passage therethrough defining entrance and exit ends thereof. The yarn passage has an adjacent access slot to facilitate string-up and at least one fluid conduit per yarn passage for admitting treating fluid thereinto. The essential elements are an exhaust muffler and access slot silencing means.

The exhaust muffler comprises a metal housing, pivot means, means for mounting the housing on the jet, a metal sound absorbing liner, and means for mounting the liner to the interior of the housing. The metal housing is located at and substantially surrounds the exit end of the jet and substantially surrounds the yarn to a point downstream thereof; the housing has an opening for passage of yarn therethrough. A portion of the housing is movable and functions as a door which pivots to an open position for access to the jet during string-up and to a closed position for treatment during operation. The pivot means (typically, a hinge) connects the housing and the portion thereof which functions as a door. Means is provided for mounting the housing on the jet.

The metal sound absorbing liner comprises a plurality of contiguous resonant chambers, a sintered metal sheet, and a perforated metal sheet. The liner is adapted for connection to the interior of the housing without interfering with the pivotal movement thereof and without blocking the passage of yarn therethrough. The resonant chambers are adjacent the housing and the perforated metal sheet is furthest away from the housing. The resonant chambers open in a plane transverse to that of the yarn passage if extended through the housing. Means is provided for mounting the liner to the interior of the housing.

The access slot silencing means comprises a projection of the housing, an extensible member, and closure means. The projection is an extension of the housing door in the direction of the jet entrance, and it pivots with the door into an open and a closed position. The projection has the extensible member mounted thereon on the side closer to the jet when in the closed position. The extensible member has the closure means, which is shaped so as to block the access slot of the jet when brought into proximate relationship therewith, attached thereto on the end closer to the jet when in the closed position. The closure means, when the jet is operational and the projection is pivoted along with the housing door towards the access slot, closes due to the vacuum-like action induced on the closure means and extensible member by the treating fluid.

The noise level of the jet is changed from a continuous source to an intermittent source, emitting high level noise only during string-up, by the automatic closure of this access slot and exhaust muffler. The noise level of the jet is reduced by up to $16 \pm 1.5$ $\Delta$dB(A) when the housing door and projection are in the closed position.

The exhaust muffler and access slot silencing means of the present invention are preferably used in conjunction with one another, but may be used independently as each contributes to a reduction of noise. Use of the access slot silencing means independent of the exhaust muffler necessitates a change only in the manner of its mounting, and use of the exhaust muffler independent of the access slot silencing means requires a change only in its means of closure which can be achieved, for example, by means of a conventional latching mechanism.

In a preferred embodiment, the noise reduction system of the present invention is used in combination with a draw point localizing jet wherein advancing yarn is subjected to pressurized, superheated fluid flow. The draw point localizing jet has at least one yarn passage passing therethrough and defining yarn entrance and exit ends thereof. The yarn passage has an adjacent access slot to facilitate string-up and has at least one fluid conduit per yarn passage for admitting treating fluid thereinto. The major elements of the noise reduction system are an exhaust muffler and access slot silencing means. The exhaust muffler comprises a boxlike metal housing, means for mounting the housing on the jet, two metal sound absorbing inserts, and means for mounting the inserts. The housing is located at the exit end of the jet, one corner of the housing being hinged so as to provide a door which pivots to an open position for access to the jet during string-up and to a closed position for treatment during operation. The door is located on the side of the housing corresponding to the side of the jet having the access slot therein. The housing comprises two chambers separated by baffle means connected to and extending inward from the exit of the housing towards the exit end of the jet. The baffle means extends to a point just short of the jet exit so that a gap is left between the baffle means and the exit end of the jet, the gap providing a sight line for an operator. The first of the chambers substantially surrounds the exit end of the jet as well as the yarn to a point downstream thereof with an opening for passage of the yarn therethrough. The second of the chambers is positioned contiguous to the first chamber. Means is provided for mounting the housing on the jet. Each of the two metal sound absorbing inserts comprises a metal frame, a metallic honeycomb sheet, a sintered metal sheet, a perforated metal sheet, and means for sandwiching these elements. The first of the inserts has a U-shape, and is mounted opening towards the door in the first chamber. The second of the inserts has a shape corresponding to the interior portion of the door and is mounted thereon. Both of the inserts are adapted for removable connection to the housing and the interior portion of the door so as to line the first chamber without blocking the passage of yarn therethrough. The metal frame of the inserts is adjacent the housing, and the perforated metal sheet is furthest away from the housing. The honeycomb sheet is adjacent the frame, and the sintered metal sheet is adjacent the perforated metal sheet. The cells of the honeycomb sheet open in a plane transverse to that of the yarn passage if extended through the first chamber. The distance between the sintered metal sheet and the metal frame which is occupied by the honeycomb sheet is approximately 0.25 sound wavelength, which corresponds to sound frequencies of 8,000 and 16,000 cycles per second, while the open area of the perforated metal sheet ranges from 30 to 45%. Means is provided for mounting the inserts to the walls defining the first chamber and the interior of the door. The access slot silencing means comprises a projection of the housing, a mounting plate, a silencing plate, a pin, and a compression spring. The projection is an extension of the housing door in the direction of the jet entrance, and pivots with the door into an open and a closed position. The projection blocks access to the side of the jet having the access slot therein when in the closed position. The projection has the mounting plate spaced therefrom and attached thereto on the side closer to the jet when in the closed position. The mounting plate has a slot with the pin passing therethrough; the pin is connected on the end located closer to the jet to the silencing plate and is connected at its other end to stopping means which prohibits its passing completely through the slot. The compression spring surrounds the portion of the pin located between the projection and the slot. The silencing plate corresponds in length and is slightly wider than the access slot in the jet. The apparatus comprising the aforementioned noise reduction system functions to change the noise level of the jet from a continuous to an intermittent source, emitting high level noise only during string-up and alignment, in two ways: (1) by the automatic closure of the access slot by the silencing plate when the jet is operational and the projection is pivoted along with the housing door to within 1.5 inches of the access slot, closure of the access slot resulting from the vacuum-like action induced by the treating fluid; and (2) by the closure of the access slot simultaneously closing the housing door to close the first chamber of the exhaust muffler thereby reducing noise at the yarn exit. The noise level of the jet is reduced by up to 16 ± 1.5 ΔdB(A) when the housing door and projection are in the closed position.

DETAILED DESCRIPTION OF THE DRAWINGS

With reference to the accompanying drawings, like numbers indicate like apparatus. In the preferred embodiment of the invention, a single yarn end 11 is strung-up and drawn in a draw point localizing jet 13.

Figure 1:
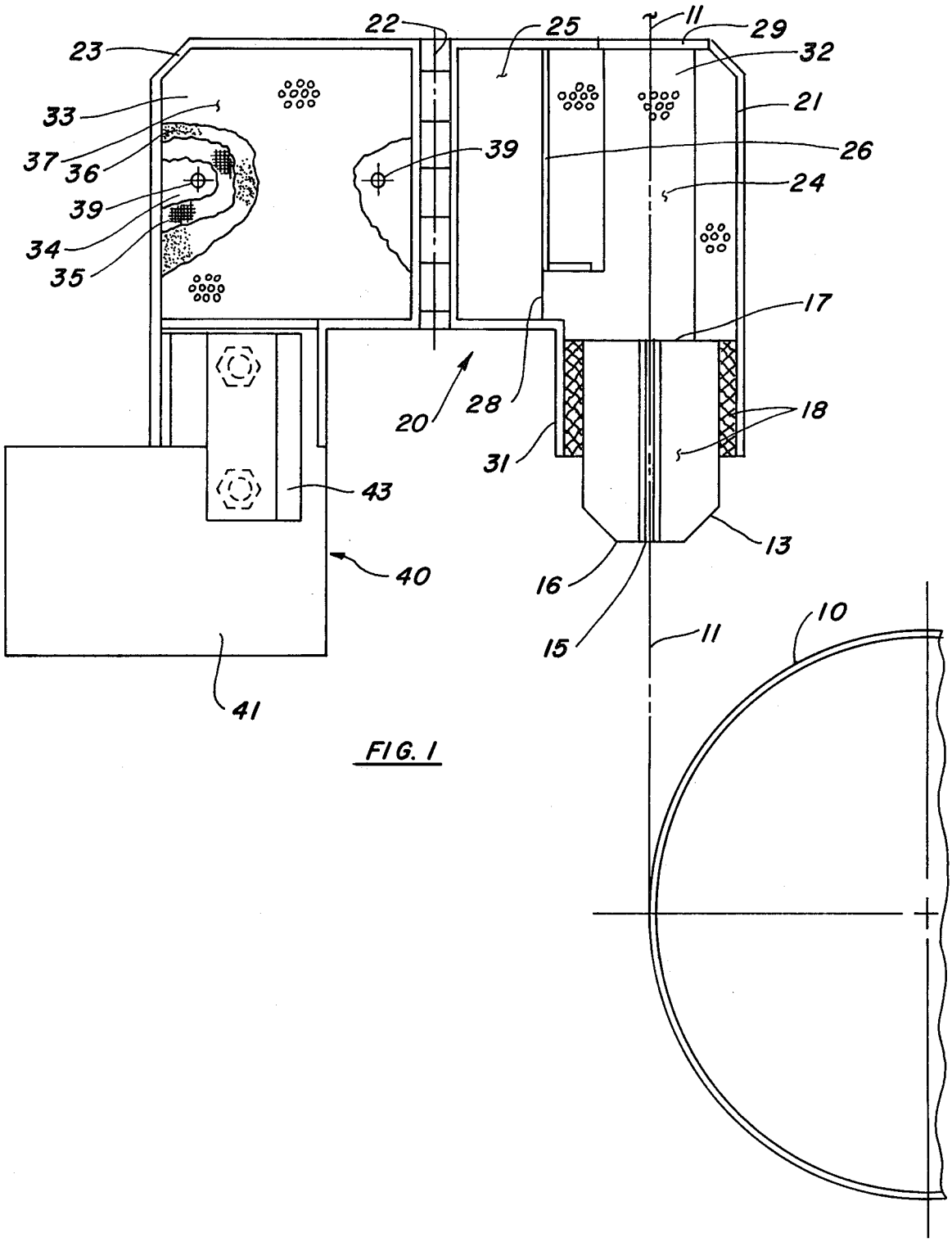
FIG. 1 is a front view of the apparatus comprising the present invention in the open position with the internals of insert 33 mounted on housing door 23 partially cut away.
Figure 3:
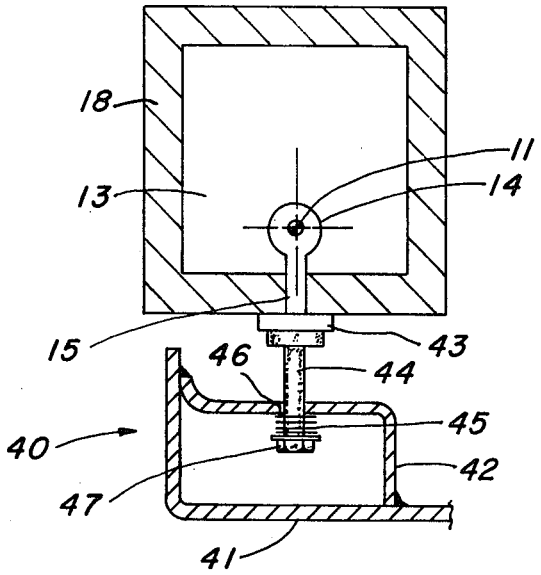
FIG. 3 is a sectional view taken along the line 3—3 of FIG. 2 with the access slot silencing means 40 in the closed, or extended position.

With reference to FIGS. 1 and 3, draw point localizing jet 13 has a cylindrical yarn passage 14 vertically therethrough which is centered on the path of yarn end 11 from feed Godet roll 10 to draw Godet roll (unshown). To facilitate string-up, yarn passage 14 has an adjacent access slot 15. There are fluid conduits (not shown) which open on yarn passage 14 to admit treating fluid supplied by a fluid manifold (not shown). Asbestos-free insulating material 18, such as compressed mineral wool, is secured by suitable means, for instance screws (not shown), to the sides of draw point localizing jet 13, without blocking access slot 15.

The noise reduction system of the present invention has as its major elements an exhaust muffler 20 and access slot silencing means 40.

Exhaust muffler 20 comprises a boxlike metal housing 21, means 31 for mounting housing 21 on draw point localizing jet 13, two metal sound absorbing inserts 32 and 33, and means 39 for mounting inserts 32 and 33 to housing 21. Housing 21 is located at the exit end 17 of draw point localizing jet 13 and has one corner 22 which is hinged so as to provide a door 23 which pivots to an open position (see FIG. 1) for access to draw point localizing jet 13 during string-up and to a closed position (see FIG. 2) for treatment during operation. Door 23 is located on the side of housing 21 corresponding to the side of draw point localizing jet 13 having access slot 15 therein. Housing 21 comprises two chambers 24 and 25 separated by baffle means 26 connected to and extending inward from the exit of housing 21 towards exit end 17 of draw point localizing jet 13. Baffle means 26 extends to a point just short of jet exit 17 so that a gap 28 is left between baffle means 26 and exit end 17 of draw point localizing jet 13. Gap 28 provides a sight line for an operator's mirror during alignment of yarn end 11. The first 24 of the chambers substantially surrounds exit end 17 of draw point localizing jet 13 and surrounds yarn end 11 to a point downstream thereof, and has an opening 29 for passages of yarn end 11 therethrough. The second 25 of the chambers is positioned contiguous to first chamber 24.

Means 31 is provided for mounting housing 21 on draw point localizing jet 13 and is depicted in the drawings as a flange extending downwardly from housing 21 on the sides of draw point localizing jet 13 other than the side having access slot 15 therein. The flange is adapted for connection to insulating material 18 by suitable means, for instance screws (not shown), to thereby preclude any contact between draw point localizing jet 13 and housing 21. Insulating material 18 functions as an interface between housing 21 and draw point localizing jet 13 and prevents conduction of heat, which is a process variable, away from draw point localizing jet 13 while also preventing overheating of housing 21 and consequently, exhaust muffler 120.

Figure 5A:
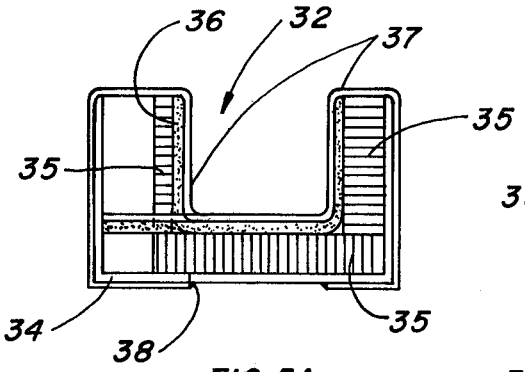
FIGS. 5A and 5B are plan views of inserts 32 and 33, respectively.
Figure 5B:
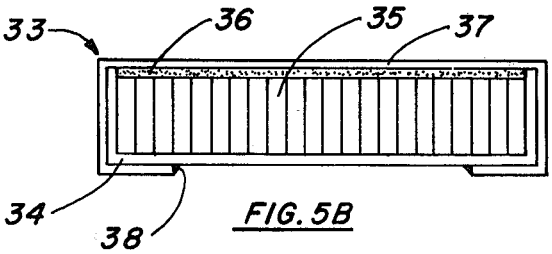

With reference to FIGS. 5A and 5B, two metal sound absorbing inserts 32 and 33 each comprise a metal frame 34, a metallic honeycomb sheet 35, a sintered metal sheet 36, a perforated metal sheet 37, and means 38 for sandwiching these elements. The first 32 of the inserts has a U-shape and is mounted opening towards door 23 in first chamber 24. The second 33 of the inserts has a shape corresponding to the interior portion of door 23 and is mounted thereon. Inserts 32 and 33 are adapted for removable connection to, respectively, housing 21 and the interior portion of door 23 so as to line first chamber 24 without blocking the passage of yarn end 11 therethrough. Metal frame 34 of inserts 32 and 33 is adjacent housing 21 while perforated metal sheet 37 is furthest away from housing 21. Honeycomb sheet 35 is adjacent metal frame 34, and sintered metal sheet 36 is adjacent perforated metal sheet 37. The cells of honeycomb sheet 35 open in a plane transverse to that of yarn passage 14 if extended through first chamber 24. The distance between sintered metal sheet 36 and metal frame 34 which is occupied by honeycomb sheet 35 is approximately 0.25 sound wavelength, which corresponds to sound frequencies of 8,000 and 16,000 cycles per second, while the open area of perforated metal sheet 37 ranges from 30 to 45%. Means 39 is provided for mounting inserts 32 and 33 to the walls defining first chamber 24 and to the interior of door 23, for instance by screws.

Figure 4:
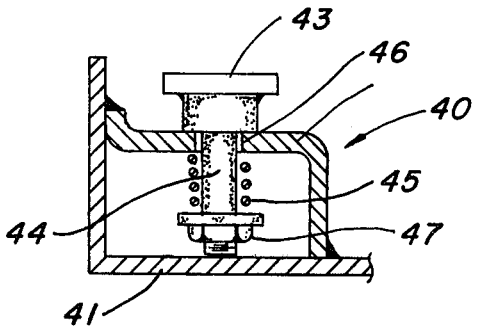
FIG. 4 is a view similar to FIG. 3 with the access slot silencing means 40 in the open, or retracted, position.

Referring to FIGS. 3 and 4, access slot silencing means 40 comprises a projection 41 of housing 21, a mounting plate 42, a silencing plate 43, a pin 44, and a compression spring 45. Projection 41 is an extension of housing door 23 in the direction of jet entrance 16, and projection 41 pivots with door 23 into an open and a closed position; projection 41 blocks access to the side of draw point localizing jet 13 having access slot 15 therein when in the closed position. Projection 41 has mounting plate 42 spaced therefrom and attached thereto on the side closer to draw point localizing jet 13 when in its closed position. Mounting plate 42 has a slot 46 with pin 44 passing therethrough. Pin 44 is connected on the end located closer to draw point localizing jet 13 to silencing plate 43 and is connected at its other end to stopping means 47 which prohibits its passing completely through slot 46. Stopping means 47 may, for instance, be a bolt, as depicted, or a flaring of the end of pin 44. Compression spring 45 surrounds the portion of pin 44 located between projection 41 and slot 46. Silencing plate 43 corresponds in length and is slightly wider than access slot 15 in draw point localizing jet 13.

Figure 2:
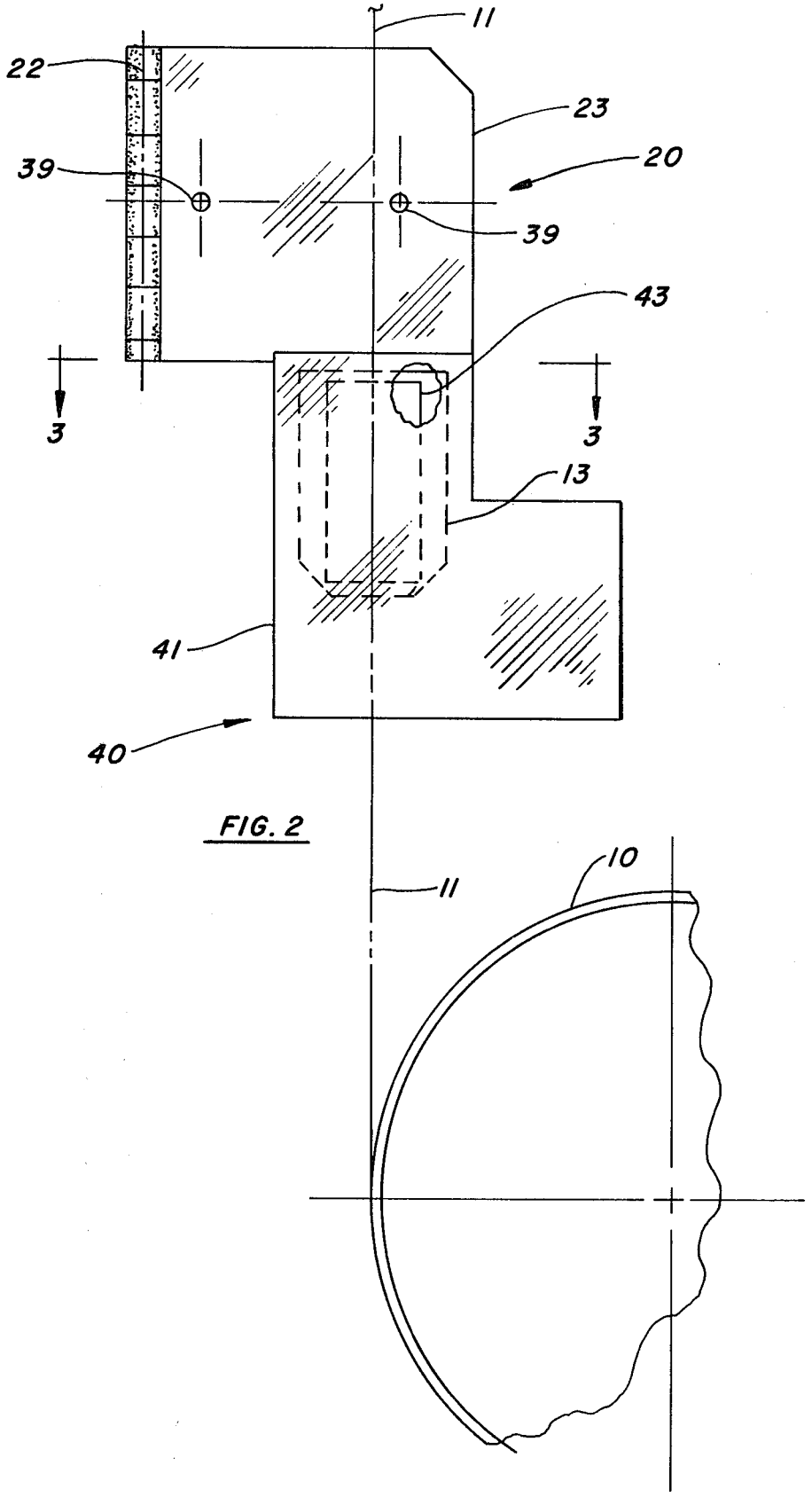
FIG. 2 is a front view of the apparatus comprising the present invention in the closed position with draw point localizing jet 13 shown in phantom.

Yarn end 11, which is supplied from an unshown source, is passed over feed Godet roll 10, strung-up through draw point localizing jet 13, passed over draw Godet roll (unshown), and then strung-up through further process apparatus (unshown). It is highly desirable and preferred that the alignment system disclosed in U.S. Patent No. 3,880,338, assigned to Allied Chemical Corporation, be interposed between feed Godet roll 10 and draw point localizing jet 13, especially during the treatment of multiple ends of yarn. At the commencement of string-up, housing door 23 and housing projection 41 are in the open position (see FIG. 1) to provide access to draw point localizing jet 13. Treating fluid is supplied, and the operator brings yarn end 11 up and through yarn passage 14 via access slot 15 with string-up means (unshown); the treating fluid passes through the fluid conduits (not shown) to impinge upon yarn end 11 as it passes through yarn passage 14 of draw point localizing jet 13. The treating fluid is preferably pressurized superheated steam. After draw point localizing jet 13 has been strung-up, the operator makes a visual check by placing a mirror in second chamber 25 to ascertain whether there is a split in yarn end 11 at exit end 17 of draw point localizing jet 13. Any necessary fine adjustment for alignment purposes is now made. The noise attendant operation of draw point localizing jet 13 is primarily emitted from yarn passage 14 at its exit end 17 and the adjacent access slot 15. The high velocity of the treating fluid as it issues from the fluid conduits into yarn passage 14 creates an atmosphere of suction which pulls inward at access slot 15. After string-up and alignment are completed, housing projection 41 is manually pivoted close enough to draw point localizing jet 13 that the aforementioned suction effect induces it to achieve its closed position. Referring to FIGS. 2 and 3, silencing plate 43 is pulled by the suction into its extended position to cover access slot 15. It should be noted that silencing plate 43 abuts insulating material 18 on either side of access slot 15 to thereby preclude the previously mentioned problems with heat conduction. The extension of silencing plate 43 pulls pin 44 through slot 46 of mounting plate 42 until stopping means 47 prevents its further movement. Compression spring 45, which normally urges pin 44 and silencing plate 43 into a retracted position during string-up and alignment, is fully compressed. The achievement of the closed position by housing projection 41, which has mounting plate 42 attached thereto, results in a corresponding achievement of the closed position by housing door 23. In this manner, first chamber 24 is substantially enclosed without requiring further positive, closure means. Referring to FIGS. 2 and 3, access slot 15 has been blocked by silencing plate 43 which deflects noise issuing therefrom back into yarn passage 14. With particular reference to FIGS. 1, 5A and 5B, sound waves issuing from exit end 17 of draw point localizing jet 13 travel into exhaust muffler 20 through first chamber 24. Perforated metal sheet 37 is the component of inserts 32 and 33 situated closest to the path of yarn end 11 and functions primarily to protect yarn end 11 from snagging and breaking on the rougher finish of sintered metal sheet 36. We have found that an open area of between 30 and 45% for perforated metal sheet 37 is preferable when dealing with a frequency component situated in the high frequency levels, as is characteristic of the noise emitted by draw point localizing jet 13. The perforations preferably have a diameter of from 0.016 to 0.20 inch. There are primarily two elements of exhaust muffler 20 which function to reduce the noise level. The first element, sintered metal sheet 36, is a resistive medium whose position relative to metal frame 34 is dependent upon the frequencies to be attenuated. As the sound wave particle velocity is at a maximum at approximately 0.25 sound wavelength from metal frame 34, which corresponds to approximately 8,000 and 16,000 cycles per second in the high frequency region, sintered metal sheet 36 is placed here in order to transfer acoustical mechanical energy into heat energy. The second component comprises the individual cells of metallic honeycomb sheet 35. These cells act as individual Helmholtz resonators for noise attenuation. Air vibrations are set up within this plurality of small, contiguous resonant chambers, and sound waves which have entered the cells are emitted at a different phase therefrom. When the sound waves reenter first chamber 24 from inserts 32 and 33, phase mismatching attenuates the noise. Thus, metallic honeycomb sheet 35 reduces the noise level primarily through wave reflections and phase mismatching. The length of exhaust muffler 20 can vary between approximately 3 and 12 inches depending upon equipment restraints. Exhaust muffler 20 is essentially a reactive type system and in combination with access slot silencing means 40 results in a noise level reduction of up to $16 \pm 1.5$ ΔdB(A). Access slot silencing means 40 alone achieves a noise level reduction of up to 4.5 Δ dB (A). When treatment is to be interrupted the supply of treating fluid is cut off and silencing plate 43 of spring actuated access slot silencing means 40 returns to its retracted position. Housing door 23 and housing projection 41 are no longer in the closed position and can be pivoted into the open position for access to draw point localizing jet 13 and the interior of exhaust muffler 20. It is now that the flexibility of inserts 32 and 33 becomes evident. In FIGS. 5A and 5B, means 38 for sandwiching the elements of inserts 32 and 33 is shown as perforated metal sheet 37 wrapping around the sandwiched edge of sintered metal sheet 36, metallic honeycomb sheet 35, and metal frame 34 to be welded to the back of metal frame 34. Because of their sandwich construction, inserts 32 and 33 are easily removed when housing door 23 is in the open position for cleansing to remove any accumulated contaminant. They are then reinserted and ready for additional use. Also, as inserts 32 and 33 are comprised entirely of metal, they can withstand high temperatures, i.e., 250–500° C. It should be noted that the noise reduction levels referred to above are with the draw panel door (unshown) closed. One of the advantages of the noise reduction system of the present invention is that it changes the location of the noise source when the draw panel door is closed, i.e., it places the source higher in the draw panel. With the draw panel door open, the referred to noise reduction levels should be correspondingly lowered 2 ΔdB(A).

While the invention has been described primarily in conjunction with the muffling of noise in a draw point localizing jet with a single access slot, it is not intended to exclude the muffling of noise in other types of yarn treating jets. Various modifications and other advantages will be apparent to one skilled in the art, and it is intended that this invention be limited only as set forth in the following claims.

It is claimed:

1. In combination with a draw point localizing jet wherein advancing yarn is subjected to pressurized, superheated fluid flow, and wherein said draw point localizing jet has at least one yarn passage passing therethrough and defining yarn entrance and exit ends thereof, said yarn passage having an adjacent access slot to facilitate string-up and having at least one fluid conduit per yarn passage for admitting treating fluid thereinto, the improvements comprising:

A. an exhaust muffler, said muffler comprising:

i. a boxlike metal housing, said housing being located at said exit end of said jet, one corner of said housing being hinged so as to provide a door which pivots to an open position for access to said jet during string-up and to a closed position for treatment during operation, said door being located on the side of said housing corresponding to the side of said jet having said access slot therein, said housing comprising two chambers separated by baffle means connected to and extending inward from the exit of said housing towards said exit end of said jet, said baffle means extending to a point just short of said jet exit so that a gap is left between said baffle means and said exit end of said jet, said gap providing a sight line for an operator, the first of said chambers substantially surrounding said exit end of said jet and surrounding said yarn to a point downstream thereof and with an opening for passage of yarn therethrough, the second of said chambers being positioned contiguous to said first chamber;

ii. means for mounting said housing on said jet;

iii. two metal sound absorbing inserts, said inserts comprising a metal frame, a metallic honeycomb sheet, a sintered metal sheet, a perforated metal sheet, and means for sandwiching these elements, the first of said inserts having a U-shape and being mounted opening towards said door in said first chamber, the second of said inserts having a shape corresponding to the interior portion of said door and being mounted thereon, said inserts being adapted for removable connection to said housing and said interior portion of said door so as to line said first chamber without blocking the passage of said yarn therethrough, said metal frame of said inserts being adjacent said housing and said perforated metal sheet being furthest away from said housing, said honeycomb sheet being adjacent said frame, said sintered metal sheet being adjacent said perforated metal sheet, the cells of said honeycomb sheet opening in a plane transverse to that of said yarn passage if extended through said first chamber, the distance between said sintered metal sheet and said metal frame which is occupied by said honeycomb sheet being approximately 0.25 sound wavelength which corresponds to sound frequencies of 8,000 and 16,000 cycles per second, the open area of said perforated metal sheet ranging from 30 to 45%;

iv. means for mounting said inserts to said walls defining said first chamber and to said interior of said door, and B. access slot silencing means, said access slot silencing means comprising a projection of said housing, a mounting plate, a silencing plate, a pin, and a compression spring, said projection being an extension of said housing door in the direction of said jet entrance, said projection pivoting with said door into an open and a closed position, said projection blocking access to said side of said jet having said access slot therein when in said closed position, said projection having said mounting plate spaced therefrom and attached thereto on the side closer to said jet when in said closed position, said mounting plate having a slot with said pin passing therethrough, said pin being connected on the end located closer to said jet to said silencing plate and being connected at its other end to stopping means which prohibits its passing completely through said slot, said compression spring surrounding the portion of said pin located between said projection and said slot, said silencing plate corresponding in length and being slightly wider than said access slot in said jet; whereby the noise level of said jet is changed from a continuous source to an intermittent source, emitting high level noise only during string-up and alignment, by: (1) the automatic closure of said access slot by said silencing plate when said jet is operational and said projection is pivoted along with said housing door to within 1.5 inches of said access slot, said closure resulting from the vacuum-like action induced by said treating fluid; and (2) the closure of said access slot simultaneously closing said housing door to close said first chamber of said exhaust muffler thereby reducing noise at the yarn exit, and whereby the noise level of said jet is reduced by up to $16 \pm 1.5\ \Delta$ dB(A) when said housing door and said projection are in said closed position.

2. Apparatus as defined in claim 1 wherein the sides of said jet have an asbestos-free insulating material secured thereto which does not interfere with their operation and wherein said means for mounting said housing on said jet comprises a flange which extends downwardly from said housing on the sides of said jet other than said side having said access slot therein and which is adapted for connection to said insulating material by suitable means to thereby preclude any contact between said jet and said housing.

3. The apparatus of claim 2 wherein said insulating material is a compressed mineral wool.

4. A noise reduction system for use in conjunction with a yarn treating jet, said jet having at least one yarn passage therethrough defining yarn entrance and exit ends thereof, said yarn passage having an adjacent access slot to facilitate string-up and having at least one fluid conduit per yarn passage for admitting treating fluid thereinto, said noise reduction system comprising:

A. an exhaust muffler, said muffler comprising:

i. a metal housing, said housing being located at and substantially surrounding said exit end of said jet and substantially surrounding said yarn to a point downstream thereof and with an opening for passage of yarn therethrough, a portion of said housing being movable and functioning as a door which pivots to an open position for access to said jet during string-up and to a closed position for treatment during operation;

ii. pivot means, said pivot means connecting said housing and said portion thereof which functions as said door;

iii. means for mounting said housing on said jet;

iv. a metal sound absorbing liner, said liner comprising a plurality of contiguous resonant chambers, a sintered metal sheet, and a perforated metal sheet, said liner being adapted for connection to the interior of said housing without interfering with the pivotal movement thereof and without blocking the passage of said yarn therethrough, said resonant chambers being adjacent said housing and said perforated metal sheet being furthest away from said housing, said resonant chambers opening in a plane transverse to that of said yarn passage if extended through said housing; and v. means for mounting said liner to said interior of said housing; and B. access slot silencing means, said access slot silencing means comprising a projection of said housing, an extensible member and closure means, said projection being an extension of said housing door in the direction of said jet entrance, said projection pivoting with said door into an open and a closed position, said projection having said extensible member mounted thereon on the side closer to said jet when in said closed position, said extensible member having said closure means attached thereto on the end closer to said jet when said projection is in said closed position, said closure means being shaped so as to block said access slot of said jet when brought into proximate relationship therewith;

whereby the noise level of said jet is changed from a continuous source to an intermittent source, emitting high noise level only during string-up, by the automatic closure of said access slot and said exhaust muffler by said closure means when said jet is operational and said projection is pivoted along with said housing door towards said access slot, said closure resulting from the vacuum-like action induced on said closure means and said extensible member by said treating fluid, and whereby the noise level of said jet is reduced by up to 16 $\pm$ 1.5 $\Delta$ dB(A) when said housing door and said projection are in said closed position.

5. Apparatus as defined in claim 4 wherein the sides of said jet have an asbestos-free insulating material secured thereto which does not interfere with their operation and wherein said means for mounting said housing on said jet comprises a flange which extends downwardly from said housing on the sides of said jet other than said side having said access slot therein and which is adapted for connection to said insulating material to thereby preclude any contact between said jet and said housing.

6. The apparatus of claim 5 wherein said insulating material is a compressed mineral wool.

7. Apparatus as defined in claim 4 wherein said housing comprises two chambers separated by baffle means connected to and extending inward from the exit of said housing towards said exit end of said jet, said baffle means extending to a point just short of said jet exit so that a gap is left between said baffle means and said exit end of said jet, said gap providing a sight line for an operator, the first of said chambers substantially surrounding said exit end of said jet and surrounding said yarn to a point downstream thereof and with an opening for passage of yarn therethrough, the second of said chambers being positioned contiguous to said first chamber, said metal sound absorbing liner being removably mounted to the interior of said first chamber.

8. Apparatus as defined in claim 4 wherein the distance between said sintered metal sheet and said interior of said housing which is occupied by said contiguous resonant chambers is approximately 0.25 sound wavelength, which corresponds to sound frequencies of 8,000 and 16,000 cycles per second.

9. Apparatus as defined in claim 4 wherein the open area of said perforated metal sheet ranges from 30 to 45%.

10. Apparatus as defined in claim 4 wherein a metallic honeycomb sheet forms said plurality of contiguous resonant chambers.

11. Apparatus as defined in claim 4 wherein the elements of said liner are sandwiched together to form inserts which are adapted for removable connection to the interiors of, respectively, said portion of said housing functioning as a door and the remainder of said housing substantially surrounding said yarn to a point downstream of said exit end of said jet, and wherein means is provided for mounting said inserts to their respective portions of said interior of said housing.

12. Apparatus as defined in claim 4 wherein said jet is a draw point localizing jet.

13. Apparatus as defined in claim 4 wherein said housing is substantially rectangular in shape.

14. Apparatus as defined in claim 4 wherein said projection has a mounting plate spaced therefrom and attached thereto on the side closer to said jet when in said closed position, said mounting plate having a slot therethrough, and wherein said extensible member comprises a pin and a compression spring, said closure means comprising a silencing plate, said pin passing through said slot in said mounting plate, said pin being connected on the end located closer to said jet to said silencing plate and being connected at its other end to stopping means which prohibits its passing completely through said slot, said compression spring surrounding the portion of said pin located between said projection and said slot, said silencing plate corresponding in length and being slightly wider than said access slot in said jet.

15. In combination with a draw point localizing jet wherein advancing yarn is subjected to pressurized, superheated fluid flow, and wherein said draw point localizing jet has at least one yarn passage passing therethrough and defining yarn entrance and exit ends thereof, said yarn passage(s) having at least one fluid conduit per yarn passage for admitting treating fluid thereinto, the improvement comprising an exhaust muffler, said muffler comprising:

A. a boxlike metal housing, said housing being located at said exit end of said jet, one corner of said housing being hinged so as to provide a door which pivots to an open position for access to said jet during string-up and to a closed position for treatment during operation, said housing comprising two chambers separated by baffle means connected to and extending inward from the exit of said housing towards said exit end of said jet, said baffle means extending to a point just short of said jet exit so that a gap is left between said baffle means and said exit end of said jet, said gap providing a sight line for an operator, the first of said chambers substantially surrounding said exit end of said jet and surrounding said yarn to a point downstream thereof and with an opening for passage of yarn therethrough, the second of said chambers being positioned contiguous to said first chamber;

B. a latching mechanism for holding said door in said closed position;

C. means for mounting said housing on said jet;

D. two metal sound absorbing inserts, said inserts comprising a metal frame, a metallic honeycomb sheet, a sintered metal sheet, a perforated metal sheet, and means for sandwiching these elements, the first of said inserts having a U-shape and being mounted opening towards said door in said first chamber, the second of said inserts having a shape corresponding to the interior portion of said door and being mounted thereon, said inserts being adapted for removable connection to said housing and said interior portion of said door so as to line said first chamber without blocking the passage of said yarn therethrough, said metal frame of said inserts being adjacent said housing, said metallic honeycomb being adjacent said frame, said sintered metal sheet being adjacent said perforated metal sheet, said perforated metal sheet being furthest away from said housing, the cells of said honeycomb sheet opening in a plane transverse to that of said yarn passage if extended through said first chamber, the distance between said sintered metal sheet and said metal frame which is occupied by said honeycomb sheet being approximately 0.25 sound wavelength which corresponds to sound frequencies of 8,000 and 16,000 cycles per second, the open area of said perforated metal sheet ranging from 30 to 45%; and E. means for mounting said inserts to said walls defining said first chamber; whereby the noise level of said jet is reduced when said door is in said closed position.

16. Apparatus as defined in claim 15 wherein the sides of said jet have an asbestos-free insulating material secured thereto which does not interfere with their operation and wherein said means for mounting said housing on said jet comprises a flange which extends downwardly from said housing on the sides of said jet and which is adapted for connection to said insulating material by suitable means to thereby preclude any contact between said jet and said housing.

17. The apparatus of claim 16 wherein said insulating material is a compressed mineral wool.

18. A muffler for use in conjunction with a yarn treating jet, said jet having at least one yarn passage therethrough defining yarn entrance and exit ends thereof, said muffler comprising:

A. a metal housing, said housing being located at and substantially surrounding said exit end of said jet and substantially surrounding said yarn to a point downstream thereof and with an opening for passage of yarn therethrough;

B. means for mounting said housing on said jet;

C. a metal sound absorbing liner, said liner comprising a plurality of contiguous resonant chambers, a sintered metal sheet, and a perforated metal sheet, said liner being adapted for connection to the interior of said housing without blocking the passage of said yarn therethrough, said resonant chambers being adjacent said housing and said perforated metal sheet being furthest away from said housing, said resonant chambers opening in a plane transverse to that of said yarn passage if extended through said housing; and D. means for mounting said liner to said interior of said housing; whereby the noise level of said jet is reduced by said muffler.

19. Apparatus as defined in claim 18 wherein the distance between said sintered metal sheet and said interior of said housing which is occupied by said contiguous resonant chambers is approximately 0.25 sound wavelength, which corresponds to sound frequencies of 8,000 and 16,000 cycles per second.

20. Apparatus as defined in claim 18 wherein the open area of said perforated metal sheet ranges from 30 to 45%.

21. Apparatus as defined in claim 18 wherein a metallic honeycomb sheet forms said plurality of contiguous resonant chambers.

22. Apparatus as defined in claim 18 wherein the elements of said liner are sandwiched together to form an insert which is adapted for removable connection to said interior of said housing and wherein means is provided for mounting said insert thereto.

23. Apparatus as defined in claim 18 wherein the sides of said jet have an asbestos-free insulating material secured thereto which does not interfere with their operation and wherein said means for mounting said housing on said jet comprises a flange which extends downwardly from said housing on the sides of said jet and which is adapted for connection to said insulating material by suitable means to thereby preclude any contact between said jet and said housing.

24. The apparatus of claim 23 wherein said insulating material is a compressed mineral wool.

25. Apparatus as defined in claim 18 wherein a portion of said housing is movable and functions as a door which pivots to an open position for access to said interior thereof, pivot means and a latching mechanism also being provided, said pivot means connecting said housing and said portion thereof which functions as said door, said latching mechanism holding said housing in a closed position.

26. Apparatus as defined in claim 25 wherein said housing comprises two chambers separated by baffle means connected to and extending inward from the exit of said housing towards said exit end of said jet, said baffle means extending to a point just short of said jet exit so that a gap is left between said baffle means and said exit end of said jet, said gap providing a sight line for an operator, the first of said chambers substantially surrounding said exit end of said jet and surrounding said yarn to a point downstream thereof and with an opening for passage of yarn therethrough, the second of said chambers being positioned contiguous to said first chamber, said metal sound absorbing liner being removably mounted to the interior of said first chamber.

27. In combination with a draw point localizing jet wherein advancing yarn is subjected to pressurized, superheated fluid flow, and wherein said draw point localizing jet has at least one yarn passage passing therethrough and defining yarn entrance and exit ends thereof, said yarn passage having an adjacent access slot to facilitate string-up and having at least one fluid conduit per yarn passage for admitting treating fluid thereinto, the improvement of access slot silencing means which comprises:

A. a first support plate, said first support plate being connected by suitable means to one of the sides of said jet adjacent the side having said access slot therein;

B. a second support plate, said second support plate being hinged to said first support plate so as to permit its pivoting into an open and a closed position, said second support plate blocking access to said side of said jet having said access slot therein when in said closed position;

C. a mounting plate, said second support plate having said mounting plate spaced therefrom and attached thereto on the side closer to said jet when in said closed position, said mounting plate having a slot therethrough which approximately faces said access slot when said second support plate is in said closed position;

D. a pin, said pin passing through said slot in said mounting plate;

E. a silencing plate, said silencing plate corresponding in length and being slightly wider than said access slot in said jet and being connected to the end of said pin located closer to said jet;

F. stopping means, said stopping means being connected to the other end of said pin and functioning to prohibit the passage of said pin completely through said slot; and G. a compression spring, said compression spring surrounding the portion of said pin located between said projection and said slot; whereby the noise level of said jet is reduced by up to 4.5 Δ dB(A) by automatic closure of said access slot by said silencing plate when said jet is operational and said second support plate is pivoted to within 1.5 inches of said access slot, said closure resulting from the vacuum-like action induced by said treating fluid.

28. In combination with a yarn treating jet wherein advancing yarn is subjected to pressurized fluid flow, and wherein said jet has at least one yarn passage therethrough which has an adjacent access slot to facilitate string-up and which has at least one fluid conduit per yarn passage for admitting treating fluid thereinto, the improvement of access slot silencing means which comprises:

A. mounting means;

B. support means, said support means having pivot means thereon adapted for connection to said mounting means and about which said support means can pivot into an open position during string-up of said jet and a closed position during treatment;

C. an extensible member, said extensible member being mounted on the side of said support means which is closer to said jet when said support means is in said closed position; and D. closure means, said closure means being attached to said extensible member on the end closer to said jet when said support means is in said closed position, said closure means being shaped so as to block said access slot of said jet when brought into proximate relationship therewith;

whereby operation of said jet creates an atmosphere of suction at said access slot which pulls said closure means via extension of said extensible member to close said access slot and bring said support means into said closed position when said support means is pivoted towards said access slot.

* * * * *